United States Patent [19]

Motohashi et al.

[11] Patent Number: 4,536,082

[45] Date of Patent: Aug. 20, 1985

[54] TRANSFER TYPE ELECTROSTATIC REPRODUCING APPARATUS

[75] Inventors: Mitsuo Motohashi; Mitsugu Nemoto; Akihiko Tamura, all of Tokyo, Japan

[73] Assignee: Konishiroku Photo Industry Co., Ltd., Tokyo, Japan

[21] Appl. No.: 433,437

[22] Filed: Oct. 8, 1982

[30] Foreign Application Priority Data

Oct. 12, 1981 [JP] Japan ..... 56-161056
Oct. 12, 1981 [JP] Japan ..... 56-161057
Oct. 12, 1981 [JP] Japan ..... 56-161058

[51] Int. Cl.[3] ..... G03G 15/00

[52] U.S. Cl. ..... 355/3 SH; 355/3 TR; 355/14 E; 355/14 SH; 355/14 TR

[58] Field of Search ..... 355/3 CH, 14 CH, 3 R, 355/14 R, 14 E, 3 SH, 14 SH, 14 TR, 3 TR; 430/126, 48

[56] References Cited

U.S. PATENT DOCUMENTS 3,788,739 1/1974 Coriale ..... 355/3 R X
4,159,172 6/1979 Tani et al. ..... 355/3 TR
4,233,381 11/1980 Landa ..... 430/126 X
4,254,206 3/1981 Draai et al. ..... 430/126
4,284,344 8/1981 Okamoto et al. ..... 355/14 CH X
4,326,796 4/1982 Champion et al. ..... 355/3 CH X
4,348,098 9/1982 Koizumi ..... 430/126 X
4,348,100 9/1982 Snelling ..... 355/14 R
4,353,648 10/1982 Tanaka et al. ..... 355/14 SH X
4,363,550 12/1982 Toshimitsu et al. ..... 355/3 TR
4,367,032 1/1983 Sakamoto et al. ..... 355/3 SH X

*Primary Examiner*—A. C. Prescott
*Attorney, Agent, or Firm*—James E. Nilles

[57] ABSTRACT

An electrostatic reproducing apparatus wherein a detecting device for toner image density on the charge receptor and an exposure device are provided between the developing device and the charging device, a discharge current of the charging device and/or the quantity of light irradiated onto the charge receptor from the exposure device can be changed according to information from the detecting device. A detecting device for developing current at the time of development is provided in the developing device, a discharge current of the charging device can be changed according to information from the detecting device. A detecting device for a surface potential on the charge receptor after formation of the electrostatic latent image is provided, a discharge current of the charging device can be changed according to an output signal from the detecting means.

9 Claims, 13 Drawing Figures

TRANSFER TYPE ELECTROSTATIC REPRODUCING APPARATUS

BACKGROUND OF THE INVENTION

1. Field of the Invention

This invention relates to improvement of an electrostatic reproducing apparatus provided with a corona charge generator for detaching a transfer paper, having a lamp for exposing a photosensitive member before transfer and after development.

2. Description of the Prior Art

A conventional type of electrostatic reproducing apparatus has a pretransfer exposure lamp which irradiates the surface of a photosensitive member subjected to a toner development under a constant condition irrespective of change in a document and a transfer paper, and then a corona charge generator for detaching the transfer paper, i.e. a separating electrode, generates a charge onto the back of the transfer paper.

Generally, an electrostatic reproducing apparatus in which a transfer paper is detached by means of a separating electrode has no separating means coming in direct contact with the photosensitive member and hence is superior in having no possibility of damaging the photosensitive member or partly cutting a toner image as compared with a transfer type electrostatic reproducing apparatus using a separating claw and a separating belt. However, in a conventional electrostatic reproducing apparatus using a separating electrode, there may be a case where a transfer paper is not detached stably or transfer rate of the toner image changes from one type of document to another.

In case, for example, an area ratio of the photosensitive member is large at a portion where the surface potential is high, as in the case of a photo document, and an area ratio of the photosensitive member is small at a portion where the surface potential is high as in the case of a character document, a constant irradiation condition of the pretransfer exposure lamp and a constant charge generating condition of the separating electrode cannot ensure a detachment in the same way and can cause a difference in the transfer efficiency of the toner image.

Table 1 indicates the results obtained in examining a relation between a difference in the photosensitive member surface potential before development, which may arise in accordance as the document varies, and detachability of the transfer paper with changes in discharge current of the separating electrode, using the Se-Te system for the photosensitive member. The discharge current of the transfer electrode was 30 μA (DC) in the test.

TABLE 1

Photosensitive member surface potential and detachability

| Photosensitive member surface potential (V) | Separating electrode discharge current (μA) | | | | | |
|---|---|---|---|---|---|---|
| | 30 | 60 | 90 | 120 | 150 | 180 |
| 0 | X | X | X | O | O | O |
| 120 | X | X | O | O | O | O |
| 600 | O | X | X | X | X | X |

(Note)
The symbol "O" in the above table indicates that the transfer paper transferred to an A4-sized sheet 50 g/m$^2$ in basis weight has been detached perfectly; the symbol "X" indicates that the transfer paper has not been detached perfectly.

The result given in Table 1 indicates that the transfer paper can be detached perfectly at all times if the discharge current of the separating electrode is changed to cope with any big change in the photosensitive member surface potential due to a change of the document. However, with reference to a detachment of the transfer paper, the discharge current of the separating electrode should relate largely to the surface potential of the photosensitive member after development rather than before toner development. Therefore, results given in FIG. 1 and FIG. 2 are obtained through examining the effect of the discharge current of the separating electrode.

In FIG. 1 and FIG. 2, $V_1$ denotes the surface potential of a transfer paper 1, the same as that in Table 1, immediately after passing a separating electrode 2, and $V_2$ denotes the surface potential of a photosensitive member 3 appearing on the lower side thereof, respectively as shown in FIG. 3. The surface potential $V_2$ can be regarded as coming near to the surface potential of the photosensitive member after development. Then, FIG. 1 indicates a result when the photosensitive member surface potential in Table 1 is 600 V; FIG. 2 indicates a result when the photosensitive member surface potential is 120 V.

From comparing measured results of FIG. 1 and FIG. 2 with that of Table 1, it is understood that the transfer paper 1 is ready for perfect detachment when the surface potential $V_1$ of the transfer paper 1 after passing the separating electrode 2 becomes almost equal to the surface potential $V_2$ of the photosensitive member, appearing on the lower side thereof, and a perfect detachment will not be secured under the state wherein a relative potential difference is present between the two surface potentials $V_1$, $V_2$.

What is conceivable from the above is that the reason why the transfer paper 1 is drawn toward the photosensitive member 3 in FIG. 3 is that an electric field due to a charge on the photosensitive member 3 and an induced charge on the photo sensitive member substrate 4 works on a charge on the transfer paper 1, and the charge on the transfer paper 1 prevents detachment of the transfer paper 1 and also causes a relative potential difference between the surface potential $V_1$ of the transfer paper 1 and the surface potential $V_2$ of the photosensitive member 3 appearing on the lower side thereof, and when the charge is eliminated by the separating electrode 2, the transfer paper 1 is brought to a state like a conductive material, and an electrostatic adsorption of the transfer paper 1 is released for detachment. Be that as it may, FIG. 1 and FIG. 2 illustrate that for detachability of the transfer paper the discharge current required at the separating electrode is more dependent upon the photosensitive member surface potential after development than upon the photosensitive member surface potential before development. It is therefore preferable that the photosensitive member surface potential after development be grasped securely so as to detach the transfer paper perfectly at all times by controlling the discharge current of the separating electrode. Then, it has been found that there is a correlation between the photosensitive member surface potential and a current flowing in a development electrode at the time of development.

It was therefore conceived that density of the toner picture would be utilized. The toner picture density can be measured stably without contact by combining a light emitting element and a light receiving element.

FIG. 4A is a graph obtained through examining a relation between the photosensitive member surface potential before toner development and the toner picture density after development. For the toner picture density, an infrared LED having a peak at 9,500 Å works as a light emitting element, a phototransistor works as a light receiving element, the light receiving element detects the strength of reflected light from the light emitting element on the photosensitive member surface before and after the photosensitive member is subjected to toner development, and the toner picture density is indicated by the output voltage from a density detecting circuit, corresponding to the difference between the two detection outputs of the light receiving element. As will be apparent from FIG. 4A, the toner picture density increases as the photosensitive member surface potential rises, but its rate of rise decreases suddenly when the photosensitive member surface potential exceeds 600 V. However, as will be understood from Table 1, the discharge current of the separating electrode will have to be changed substantially in the range of photosensitive member surface potential up to 600 V. Moreover, toner picture gives information about the photosensitive member surface after development, therefore it can be used for full control of the discharge current of the separating electrode.

The above represents the case where a pretransfer exposure is not carried out, however, the pretransfer exposure after development may deteriorate the surface potential of the photosensitive member. Therefore, from the results given in FIG. 1 and FIG. 2, detachability of the transfer paper will be changed naturally according to the pretransfer exposure.

Table 2 shows how the result of Table 1 will change according to the pretransfer exposure, indicating a detachability of the transfer paper when the photosensitive member surface is irradiated at 30 lux sec. with a cold cathode fluorescent tube having a peak at about 400 nm after toner development and before transfer. Conditions of the transfer paper and the photosensitive member are the same as for Table 1.

TABLE 2

| Detachability at pretransfer exposure | | | | | | |
|---|---|---|---|---|---|---|
| Photosensitive member surface potential (V) | Separating electrode discharge current (μA) | | | | | |
| | 80 | 100 | 120 | 140 | 160 | 180 |
| 0 | X | X | X | O | O | O |
| 120 | X | X | X | O | O | O |
| 600 | X | X | O | O | O | O |

As will be apparent from the result given in Table 2, the transfer paper can be detached perfectly in the case of a photo document by carrying out the pretransfer exposure at 30 lux sec. under the same condition as a character document. However, since the pretransfer exposure may involve a fatigue on the photosensitive member, the quantity of light must be adjusted as little as possible.

FIG. 5 shows circumstances of fatigue of the surface potential of two photosensitive members which are electrified under the same conditions before exposure of an original image, one being not subjected to the pretransfer exposure and the other subjected to the pretransfer exposure under the same conditions as Table 2, and showing the change for repetitive transfer; it can be understood that the photosensitive member is considerably fatigued even by the pretransfer exposure at 30 lux sec. In FIG. 5, a photosensitive member of the Se-Te system is also used.

Table 3 and Table 4 show results obtained through examining the relation between the quantity of light of pretransfer exposure and effect; Table 3 shows the relation between rate of pretransfer exposure and detachability of the transfer paper, which is obtained through using various thicknesses of A4-sized transfer papers, and Table 4 shows the relation between rate of pretransfer exposure and transfer efficiency, i.e. the ratio of transfer toner quantity to development toner quantity. In both Table 3 and Table 4, the same conditions as for Table 2 are used for the photosensitive member and the pretransfer exposure lamp, a discharge current of the separating electrode is specified at 130 μA, and a discharge current of the transfer electrode 5 shown in FIG. 3 is specified at 30 μA. The transfer paper of Table 4 is 65 g/m$^2$ in basis weight.

TABLE 3

| Rate of pretransfer exposure and detachability | | | |
|---|---|---|---|
| Pretransfer exposure (lux sec.) | Transfer paper (g/m$^2$) | | |
| | 50 | 65 | 127 |
| 0 | 0 | 35 | 100 |
| 13 | 0 | 100 | 100 |
| 24 | 20 | 100 | 100 |
| 30 | 100 | 100 | 100 |

TABLE 4

| Rate of pretransfer exposure and transfer efficiency | |
|---|---|
| Pretransfer exposure (lux sec.) | Transfer efficiency (%) |
| 0 | 70 |
| 15 | 80 |
| 33 | 88 |

As will be apparent from Table 3, even a little quantity of pretransfer exposure is effective to improve the detachability according to the thickness of transfer paper, and further is influential, from Table 4, in improvement of transfer efficiency.

It was then conceived to utilize information toner developer current to get information about the photosensitive member surface potential easily, and to get information more directly related to the situation after development.

FIG. 4B indicates the relation between photosensitive member surface potential before development and developing current flowing in a development bias circuit when the photosensitive member surface at the potential is developed at a toner developer. As is self-explanatory in FIG. 4B, the developing current increases almost in proportion to the photosensitive member surface potential when the photosensitive member surface potential runs at 200 V or over, and then the discharge current of the separating electrode must be changed for stable detachment of the transfer paper, as indicated in Table 1, when the photosensitive member surface potential exceeds 200 V, therefore information on the developing current can be utilized for full control of the separating electrode for stable detachment of the transfer paper.

SUMMARY OF THE INVENTION

This invention has been done according to the results as described above, and a transfer type electrostatic reproducing apparatus of the invention which is provided with a corona charge generator for detaching the transfer paper or further with a lamp for exposing the photosensitive member before transfer and after development, is characterized in that a discharge current of the corona charge generator and/or a light irradiated onto the photosensitive member from the exposure lamp can be changed according to a signal corresponding to a picture density on the photosensitive member.

A transfer type electrostatic reproducing apparatus in another embodiment of the invention which is provided with a corona charge generator for detaching the transfer paper or further with a lamp for exposing the photosensitive member before transfer and after development, is characterized in that a discharge current of the corona charge generator and/or a light irradiated onto the photosensitive member from the exposure lamp can be changed according to a developing current information at the time of development on a toner developer.

A transfer type electrostatic reproducing apparatus in further embodiment of the invention which is provided with a ccorona charge generator for detaching the transfer paper or further with a lamp for exposing the photosensitive member before transfer and after development, is characterized in that the photosensitive member surface potential before development and after projection of an original image is detected, and a discharge current of the corona charge generator and/or a light irraidated onto the photosensitive member from the exposure lamp can be changed according to the detection signal.

Other objects and features of this invention will be elucidated in accordance with a description of the accompanying drawings.

DESCRIPTION OF THE PREFERRED EMBODIMENTS

The invention will now be described with reference to FIG. 6 to FIG. 8.

Figure 6:
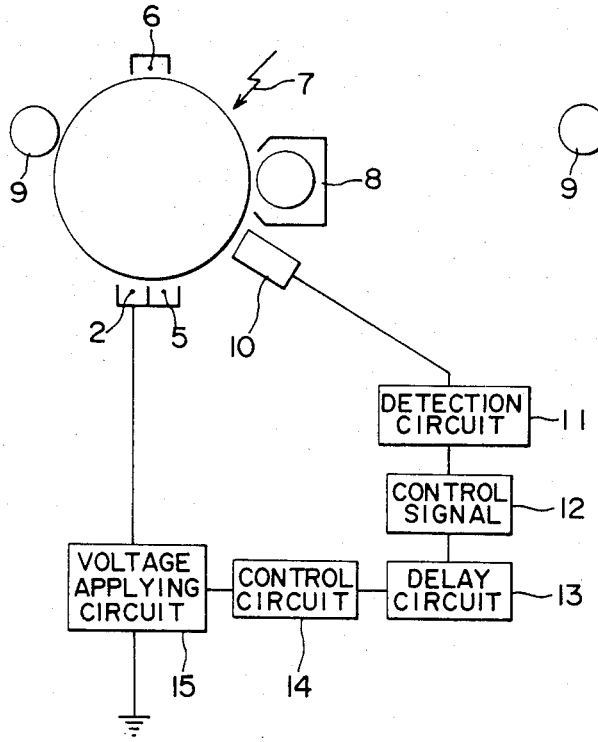
FIG. 6 and FIG. 7 are schematic block diagrams of a reproducing apparatus according to this invention.

FIG. 6 is a schematic block diagram of a reproducing apparatus of this invention which operates for control of a discharge current of a separating elecctrode by detecting toner picture density on a photosensitive member; FIG. 7 is a schematic block diagram of a reproducing apparatus which operates for control of the quantity of light irradiated onto the photosensitive member from a pretransfer exposure lamp; FIG. 8 is a fragmentary side view of a light control circuit for the pretransfer exposure lamp.

Figure 1:
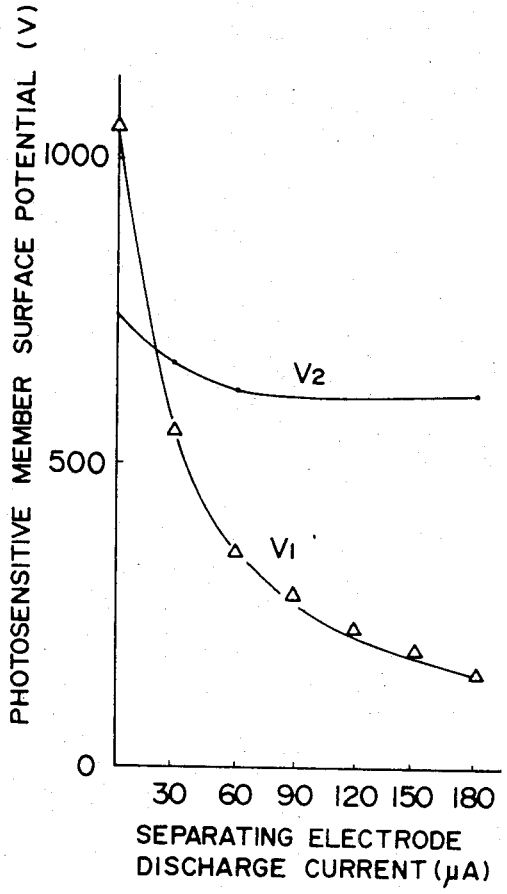
FIG. 1 and FIG. 2 are graphs indicating an influence exerted on detachment of the transfer paper by the discharge current of the separating electrode.
Figure 2:
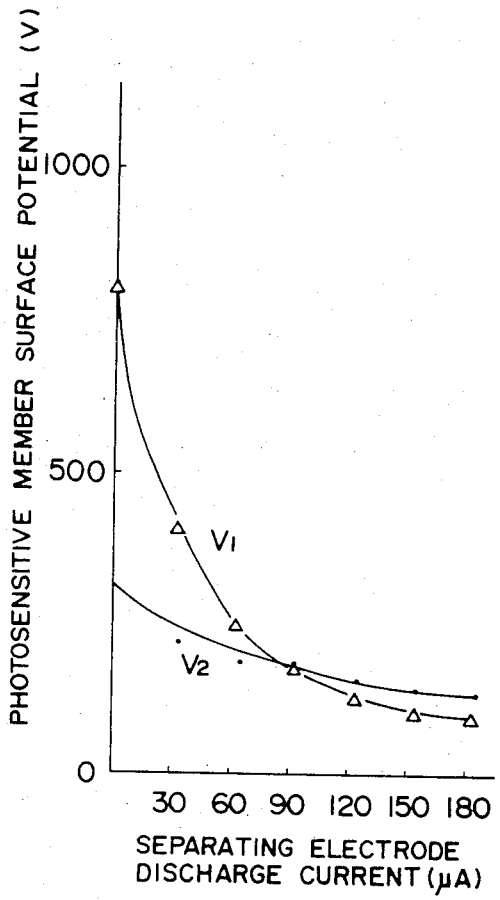
Figure 3:
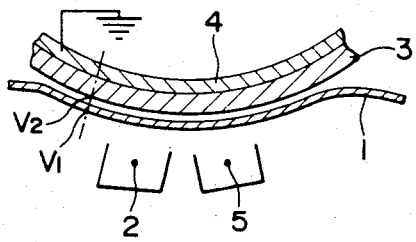
FIG. 3 is a fragmentary side view of an electrostatic reproducing apparatus indicating measuring positions in FIG. 1 and FIG. 2.
Figure 4A:
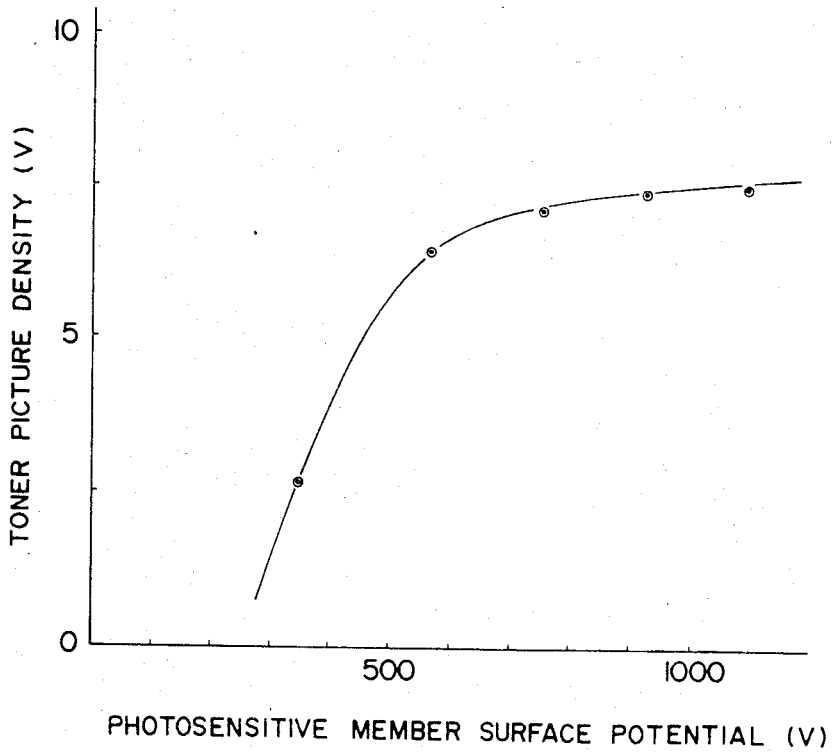
FIG. 4A is a graph indicating the relation between photosensitive member surface potential before development and toner picutre density.
Figure 7:
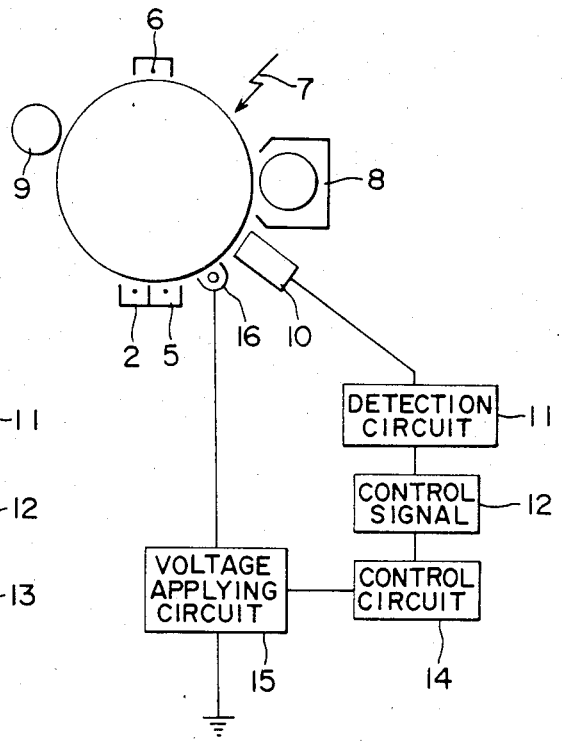
Figure 11:
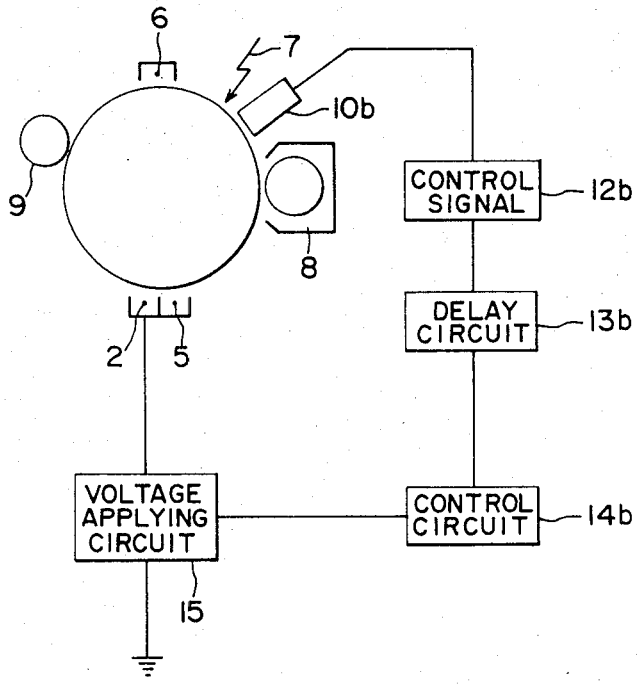

In FIG. 6 and FIG. 7, 6 denotes a charging electrode for charging the surface of a photosensitive member 3, 7 denotes an original image projecting light, 8 denotes a toner developer, 9 denotes a cleaner, 10 denotes a density detecting sensor comprising a combination of a light emitting element and a light receiving element similar to those in FIG. 4A, 11 denotes a density detecting circuit, 12 denotes a control signal generating circuit to amplify an output of the density detecting circuit 11, 13 denotes a delay circuit for delaying the output control signal of the control signal generating circuit during the interval in which a point on the surface of the photosensitive member 3 moves to the position of the separating electrode 2 from the position of the density detecting sensor 10, 14 denotes a control circuit for controlling an AC voltage applying circuit 15 according to a control signal from the delay circuit 13 or the control signal generating circuit 12 to change the discharge current of the separating electrode 2 or a quantity of light emitted from a pretransfer exposure lamp 16 using a cold cathode discharge tube similar to that in Table 2. The arrangement is such that an AC voltage is applied to the separating electrode 2 for starting a discharge before the tip of the transfer paper reaches a transfer electrode 5, to accommodate variations in timing of the feed of the transfer paper and delay in rise of the discharge, so that the tip of the transfer paper will be discharged securely.

In the reproducing apparatus of FIG. 6, the transfer paper can be detached stably, regardless of a change in documents, as from a photo doccument to a character document for example, by controlling the discharge current of the separating electrode 2 through the control circuit 14 according at least to a detection of the density detecting sensor 10, so as to obtain the results denoted by "0" marks in Table 1, in view of the relation between toner picture density and photosensitive member surface potential which is given in FIG. 4A. And in the reproducing apparatus of FIG. 7, detachability of the transfer paper can be improved as shown in Table 2 and Table 3 by a constitution wherein a pretransfer exposure lamp 16 lights up when the toner picture density becomes more than a constant, or wherein the quantity of light of the pretransfer exposure lamp 16 is increased as toner picture density increases under the condition wherein discharge current of the separating electrode 2 is kept at 140 $\mu$A or over; transfer efficiency can also be improved thereby as shown in Table 4.

Figure 8:
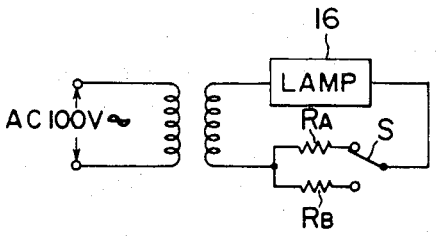
FIG. 8 is a fragmentary view of a light control circuit for a pretransfer exposure lamp.

FIG. 8 represents an example of the AC voltage applying circuit through which the quantity of light of the pretransfer exposure lamp 16 is controlled in two stages; the control circuit 14 of FIG. 7 operates to connect a change-over switch S to a resistance RA when an output of the density detecting circuit 11 is 7.5 V or below for example, thereby keeping the light of the pretransfer exposure lamp 16 at 15 lux sec., but the change-over switch S changes over to a resistance RB when the output exceeds 7.5 V, thereby keeping the light of the pretransfer exposure lamp 16 at 30 lux sec.

As described above, according to this invention, the transfer paper can be detached stably by the separating electrode regardless of a change in documents, and fatigue of the photosensitive member can be minimized even when the pretransfer exposure lamp is used.

In the invention, the density detecting sensor can be used plurally and disposed both widthwise and longitudinally of the photosensitive member. Then, a fluorescent lamp other than a cold cathode fluorescent tube, or an incandescent lamp, can be used for the pretransfer exposure lamp. Further, the quantity of light irradiated onto the photosensitive member can be adjusted through a filter without changing the lamp light.

The invention will now be described for another embodiment with reference to FIG. 9 and FIG. 10. In the drawings, like reference marks denote like parts in the embodiment described hereinbefore.

Figure 9:
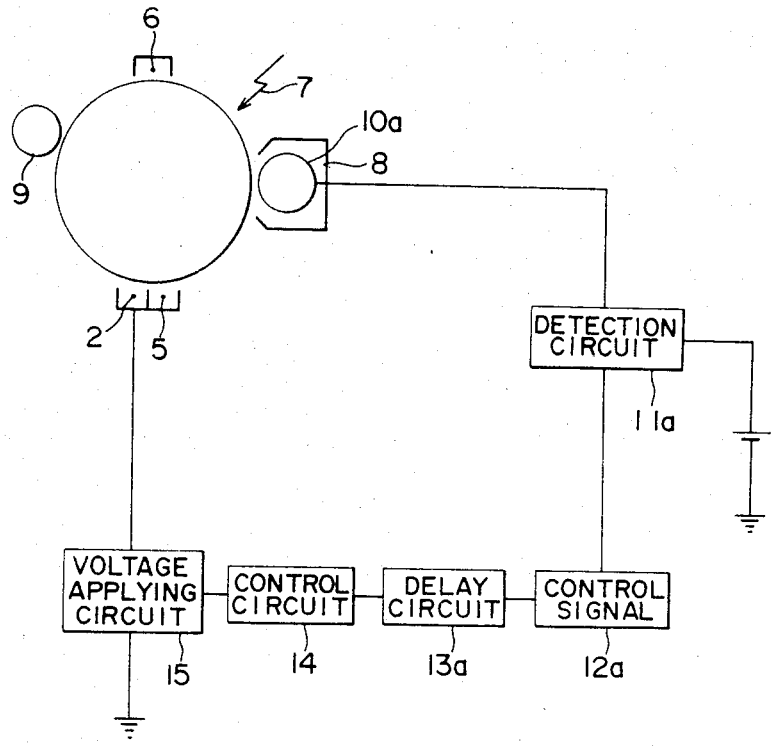
FIG. 9 to FIG. 12 are schematic block diagrams of a reproducing apparatus in another embodiment of this invention.
Figure 10:
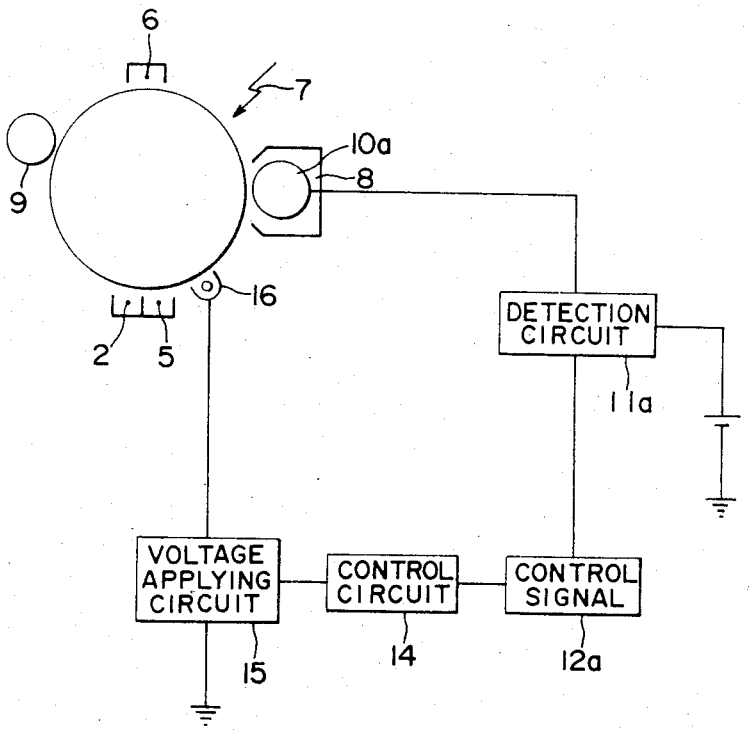

In FIG. 9 and FIG. 10, 10*a* denotes a developing sleeve of a toner developer, 11*a* denotes a detection circuit whereby a developing current, flowing in a development bias circuit when a charged toner moves from the developing sleeve 10*a* to the surface of the photosensitive member 3, is converted into voltage information, 12*a* denotes a control signal generating circuit that produces a control signal by amplifying the voltage information converted in the detection circuit 11*a*, 13*a* denotes a delay circuit to delay the output control signal of the control signal generating circuit 12*a* for the time until the surface of the photosensitive member 3 reaches the position of the separating electrode 2 from the position of the toner developer 10*a*.

Figure 4B:
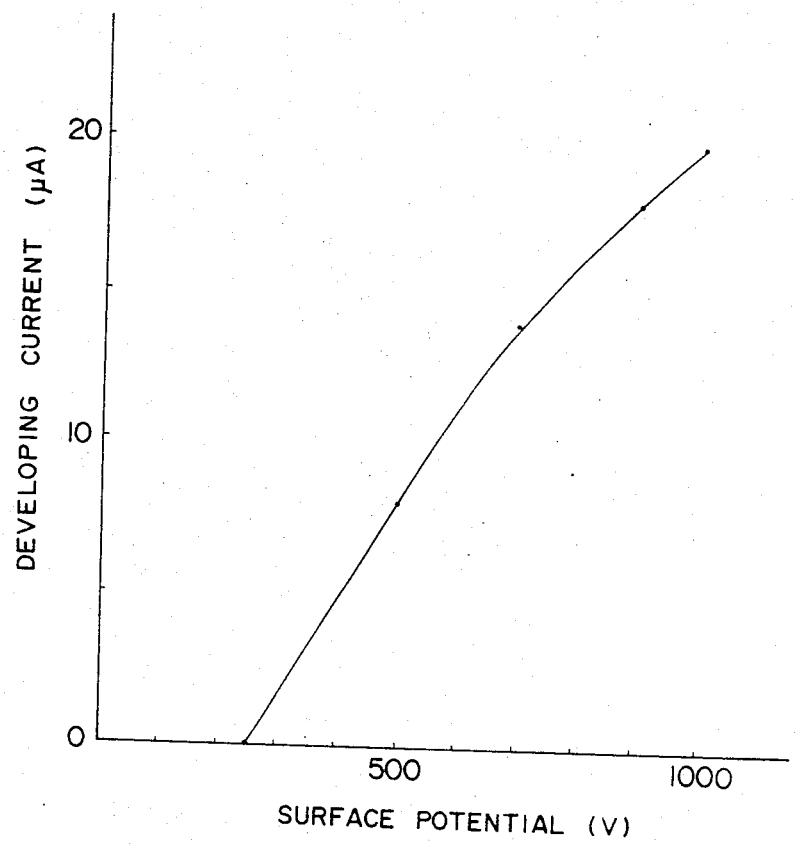
FIG. 4B is a graph indicating the relation between photosensitive member surface potential and developing current.
Figure 5:
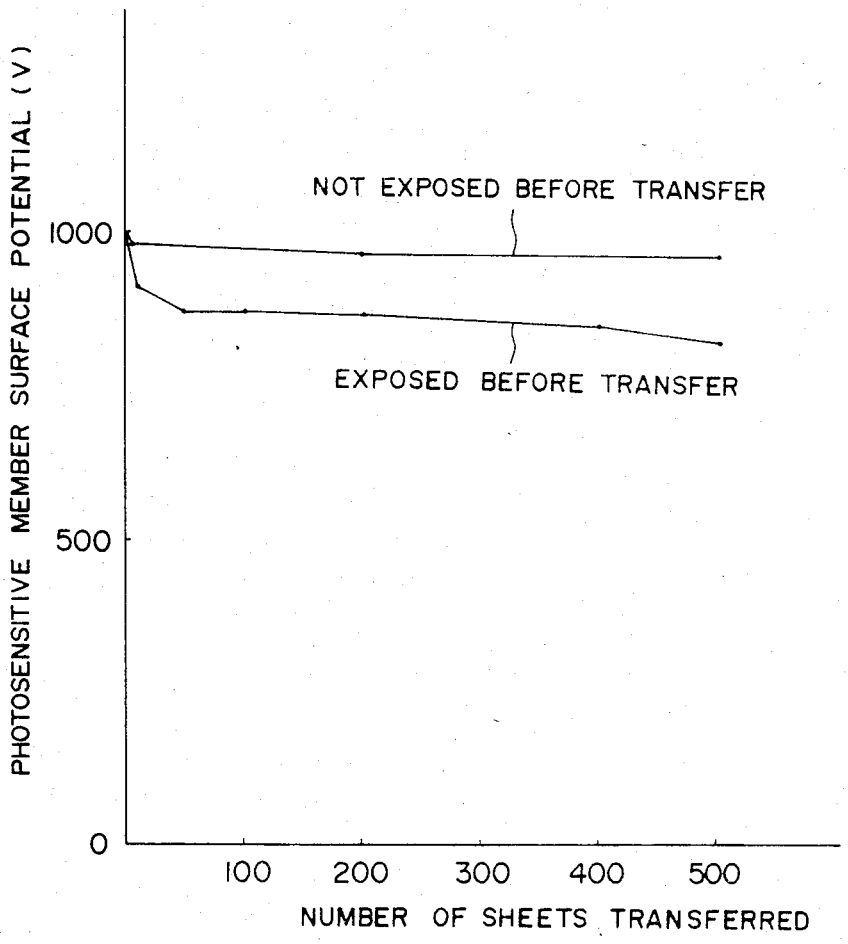
FIG. 5 is a graph indicating photosensitive member fatigue due to pretransfer exposure.

In the reproducing apparatus of FIG. 9, the transfer paper can be detached stably, regardless of a change in documents from a photo document to a character document for example, by controlling discharge current of the separating electrode 2 in the control circuit 14 according to an output of the detection circuit 11*a*, which converts developing current of the toner developer 8 into a voltage information so as to obtain the results denoted by "0" marks in Table 1, in view of the relation between developing current and photosensitive member surface potential which is illustrated in FIG. 4B. Then, in the reproducing apparatus of FIG. 10, detachability of the transfer paper can be improved as shown in Table 2 and Table 3 by a control wherein the pretransfer exposure lamp 16 lights up when the developing current reaches a value higher than a predetermined constant, or the photosensitive member surface potential reaches a value higher than a predetermined constant, or the quantity of light of the pretransfer exposure lamp 16 is increased as the developing current increases under the condition wherein a discharge current of the separating electrode 2 is kept at 140 μA or over; a transfer efficiency can also be improved thereby as shown in Table 4.

The invention will be described in a further embodiment with reference to FIG. 11 and FIG. 12. In the drawings, like reference marks denote like parts in the foregoing embodiment.

Figure 12:
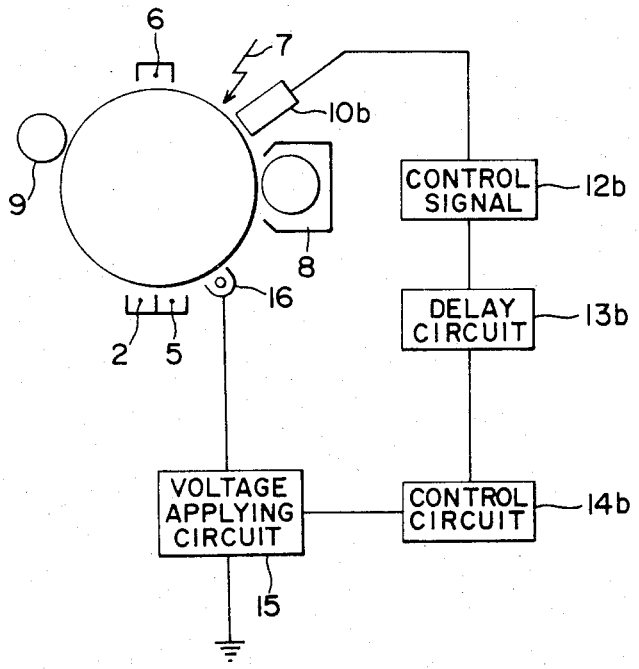

In FIG. 11 and FIG. 12, 10*b* denotes a surface potential detecting sensor, 12*b* denotes a control signal generating circuit to output a control signal according to a detection information of the detecting sensor 10*b*, 13*b* denotes a delay circuit to delay the control signal of the control signal generating circuit 12*b* for the time till the photosensitive member surface reaches a position of the separating electrode 2 or the pretransfer exposure lamp 16 from a position of the detecting sensor 10*b*, 14*b* denotes a control circuit to change a discharge ccurrent of the separating electrode 2 or the quantity of light irradiated onto the photosensitive member surface from the pretransfer exposure lamp 16 through controlling the AC voltage applying circcuit 15 according to an output signal of the delay circuit 13*b*. In the reproducing apparatus of FIG. 11, the transfer paper can be detached stably, regardless of a change in documents, a photo document and a character document for example, from controlling a discharge current of the separating electrode 2 to a value giving the result with "0" mark in Table 1 according to a photosensitive member surface potential detection of the detecting sensor 10*b*. Then, in the reproducing apparatus of FIG. 12, a detachability of the transfer paper can be improved as shown in Table 2 and Table 3 by a control wherein the pretransfer exposure lamp 16 lights up when the photosensitive member surface potential detected on the detecting sensor 10*b* becomes a value more than constant, or the quantity of light of the pretransfer exposure lamp 16 is increased in accordance with the photosensitive member surface potential gets high under the condition wherein a discharge current of the separating electrode 2 is kept at 140 μA or over; the transfer efficiency can also be improved thereby as shown in Table 4.

What is claimed is:

1. In electrostatic reproducing apparatus comprising a charge receptor which moves in one direction cyclically in a defined path and upon which an electrostatic latent image is formed in a first part of said path, developing means to which a developing current is supplied for developing the electrostatic image into a toner image in a second part of said path, transferring means for transferring the toner image from the charge receptor to a transfer medium in a third part of said path, and charging means for causing the transfer medium to be detached from the charge receptor in a fourth part of said path, the improvement characterized by:

A. exposure means for producing light which irradiates the charge receptor in a part of said path that is between said second and said third parts of said path, said exposure means being adjustably controllable for varying the quantity of light with which the charge receptor is irradiated;

B. detection means for detecting changes in the value of said developing current; and C. control means connected with said detection means and with said exposure means for controlling the quantity of light produced by the exposure means in accordance with the value of said developing current.

2. The electrostatic reproducing apparatus of claim 1 wherein a constant current is applied to said charging means and said control means is arranged to increase the quantity of light produced by said exposure means in accordance with increase in said developing current.

3. The electrostatic reproducing apparatus of claim 1 wherein said transferring means comprises an electrostatic corona discharge electrode.

4. The electrostatic reproducing apparatus of claim 1 wherein said control means is arranged to cause said exposure means to produce light only when said developing current exceeds a predetermined value.

5. In electrostatic reproducing apparatus comprising a charge receptor upon which an electrostatic latent image is formed, developing means to which a developing current is supplied for developing the electrostatic image into a toner image, transferring means for transferring the toner image from the charge receptor to a transfer medium, and charging means for causing the transfer medium to be detached from the charge receptor, the improvement characterized by:

a detecting means for detecting toner image density on said charge receptor provided between said developing means and said charging means, whereby a discharge current of said charging means can be changed according to information from said detecting means.

6. In electrostatic reproducing apparatus comprising a charge receptor upon which an electrostatic latent image is formed, developing means to which a developing current is suppied for developing the electrostatic image into a toner image, transferring means for transferring the toner image from the charge receptor to a transfer medium, and charging means for causing the transfer medium to be detached from the charge receptor, the improvement characterized by:

a detecting means for detecting toner image density on said charge receptor and an exposure means for producing light provided between said developing means and said charging means, whereby the quantity of light irradiated onto said charge receptor from said exposure means can be changed according to information from said detecting means.

7. In electrostatic reproducing apparatus comprising a charge receptor upon which an electrostatic latent image is formed, developing means to which a developing current is supplied for developing the electrostatic image into a toner image, transferring means for transferring the toner image from the charge receptor to a transfer medium, and charging means for causing the transfer medium to be detached from the charge receptor, the improvement characterized by:

a detecting means for detecting developing current at the time of development provided in said developing means, whereby a discharge current of said charging means can be changed according to information from said detecting means.

8. In electrostatic reproducing apparatus comprising a charge receptor upon which an electrostatic latent image is formed, developing means to which a developing current is supplied for developing the electrostatic image into a toner image, transferring means for transferring the toner image from the charge receptor to a transfer medium, and charging means for causing the transfer medium to be detached from the charge receptor, the improvement characterized by:

a detecting means for detecting a surface potential on said charge receptor after formation of the electrostatic latent image is provided, whereby a discharge current of said charging means can be changed according to an output signal from said detecting means.

9. In electrostatic reproducing apparatus comprising a charge receptor upon which an electrostatic latent image is formed, developing means to which a developing current is supplied for developing the electrostatic image into a toner image, transferring means for transferring the toner image from the charge receptor to a transfer medium, and charging means for causing the transfer medium to be detached from the charge receptor, the improvement characterized by:

a detecting means for detecting a surface potential on said charge receptor after formation of the electrostatic latent image, and an exposure means provided between said developing means and said charging means, whereby the quantity of light irradiated onto said charge receptor from said exposure means can be changed according to an output signal from said detecting means.

* * * * *